US009937724B2

(12) United States Patent
Hirasawa

(10) Patent No.: US 9,937,724 B2
(45) Date of Patent: Apr. 10, 2018

(54) LIQUID EJECTING APPARATUS

(71) Applicant: SEIKO EPSON CORPORATION, Tokyo (JP)

(72) Inventor: Yusuke Hirasawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/428,008

(22) Filed: Feb. 8, 2017

(65) Prior Publication Data

US 2017/0225479 A1 Aug. 10, 2017

(30) Foreign Application Priority Data

Feb. 10, 2016 (JP) ..... 2016-023393

(51) Int. Cl.
*B41J 2/175* (2006.01)
*B41J 29/13* (2006.01)

(52) U.S. Cl.
CPC ..... *B41J 2/17553* (2013.01); *B41J 2/175* (2013.01); *B41J 2/1752* (2013.01); *B41J 2/17509* (2013.01); *B41J 29/13* (2013.01)

(58) Field of Classification Search
CPC .... B41J 2/175; B41J 2/17503; B41J 2/17509; B41J 2/17513; B41J 2/17523; B41J 2/17552; B41J 2/17553; B41J 2/17556
See application file for complete search history.

(56) References Cited

U.S. PATENT DOCUMENTS 4,368,478 A * 1/1983 Koto ..... B41J 2/19 347/86
6,540,321 B1 * 4/2003 Hirano ..... B41J 2/17503 347/22
6,663,233 B2 * 12/2003 Otsuka ..... B41J 2/17506 141/114
7,347,540 B2 * 3/2008 Piock ..... B41J 2/175 347/21
7,794,067 B2 * 9/2010 Miyazawa ..... B41J 2/17513 347/85
8,678,567 B2 * 3/2014 Shimizu ..... B41J 2/17523 347/85

FOREIGN PATENT DOCUMENTS

JP 11-058769 3/1999
JP 2002-200774 7/2002
JP 2003-312000 11/2003

* cited by examiner

*Primary Examiner* — Anh T. N. Vo
(74) *Attorney, Agent, or Firm* — Workman Nydegger

(57) ABSTRACT

A liquid ejecting apparatus includes a liquid ejecting head that ejects a liquid, a subsidiary tank connected to the liquid ejecting head, and a main tank capable of supplying the liquid to the subsidiary tank. The subsidiary tank is provided with a liquid introducing portion that receives the liquid from the main tank. The liquid introducing portion includes a receiving member that receives the liquid from the main tank. The receiving member is a porous member that seals the pressure chamber by being impregnated with the liquid. The main tank includes a reservoir portion in which the liquid is stored and a connecting flow path that extends from the reservoir portion. The connecting flow path includes a terminal portion that is connectable to and disconnectable from the liquid introducing portion.

10 Claims, 9 Drawing Sheets

LIQUID EJECTING APPARATUS

BACKGROUND

1. Technical Field

The present invention relates to a liquid ejecting apparatus.

2. Related Art

An ink jet printer is a widely known liquid ejecting apparatus that ejects a liquid from a liquid ejecting head to a recording medium. The ink jet printer includes a carriage and a liquid ejecting head mounted on the carriage and performs printing by ejecting an ink (liquid) from nozzles of the liquid ejecting head while moving the carriage in a scanning manner.

Ink jet printers are roughly divided into an on-carriage type in which an ink cartridge that supplies an ink to a liquid ejecting head is mounted on a carriage and an off-carriage type in which an ink cartridge is not mounted on a carriage but is connected to a liquid ejecting head via a tube.

In the on-carriage type ink jet printer, since the ink cartridge is mounted on the carriage, there is a problem that it is difficult to increase the capacity of the ink cartridge.

The off-carriage type ink jet printer needs a structure that compensates for a pressure loss caused by a tube that connects the liquid ejecting head and the ink cartridge and a structure for preventing the tube from impeding the movements of the carriage. Therefore, the off-carriage type has a problem that the apparatus is large in size.

JP-A-11-58769 discloses an ink recording apparatus (ink jet printer) in which an ink tank (subsidiary tank) provided on the carriage is supplied with an ink by docking an ink replenishing tank provided outside the carriage to the ink tank. This system is termed herein the docking system. The ink jet printer of the docking system includes an ink tank mounted on a carriage and an ink replenishing tank that is not mounted on the carriage. The ink tank is provided with an ink filling opening and the ink replenishing tank is provided with an ink supply opening that can be connected to and disconnected from the ink filling opening of the ink tank. The ink filling opening becomes engaged with the ink supply opening, due to a movement of the carriage, so that the ink is supplied into the ink tank.

The docking type ink jet printer has a risk that an air bubble may flow into the ink tank mounted on the carriage. Therefore, there arises a need to provide a valve structure that inhibits air bubbles from flowing into the ink tank, leading to a problem that the apparatus becomes complicated.

SUMMARY

An advantage of some aspects of the invention is that a liquid ejecting apparatus that is able to supply an ink to a subsidiary tank while adopting a simple structure is provided.

A liquid ejecting apparatus according to one aspect of the invention includes a liquid ejecting head that ejects a liquid, a subsidiary tank connected to the liquid ejecting head, and a main tank capable of supplying the liquid to the subsidiary tank. The subsidiary tank is provided with a liquid introducing portion that receives the liquid from the main tank. The liquid introducing portion includes a receiving member that receives the liquid from the main tank, a pressure chamber capable of communicating with an outside via the receiving member, and a negative pressure generating mechanism that generates negative pressure in the pressure chamber. The receiving member is a porous member that seals the pressure chamber by being impregnated with the liquid. The main tank includes a reservoir portion in which the liquid is stored and a connecting flow path that extends from the reservoir portion. The connecting flow path includes a terminal portion that is connectable to and disconnectable from the liquid introducing portion.

According to this construction, when the terminal portion of the connecting flow path is connected to the liquid introducing portion, the reservoir portion of the main tank comes to communicate with the pressure chamber that is negatively pressured, so that the liquid can flow into the pressure chamber. Therefore, it is possible to automatically supply the liquid from the main tank to the subsidiary tank. Due to this, frequent replacement of cartridges as required in the related-art on-carriage type ink jet printers becomes unnecessary. Furthermore, tubes that connect ink cartridges and a liquid ejecting head as in the related-art off-carriage type ink jet printers also become unnecessary, so that it becomes possible to reduce the size of the apparatus. In the foregoing construction, the receiving member that receives the liquid from the main tank is a porous member impregnated with the liquid. When the porous member impregnated with the liquid receives negative pressure at one side thereof, meniscuses are formed at the other side thereof due to surface tension. The meniscus is a phenomenon in which the surface of a liquid in a hole becomes concave and creates a retaining force that retains liquid within the hole, balancing a predetermined negative pressure. When the receiving member is supplied with the liquid from the terminal portion, the concave meniscuses are filled with the liquid. Therefore, the pressure chamber in the negatively pressured state draws in the liquid until meniscuses are formed again in the holes of the receiving member. Because the liquid is drawn into the pressure chamber from the receiving member in this manner, inflow of air bubbles into the pressure chamber can be inhibited without a need to provide a valve structure. Therefore, unlike the related-art docking system, the need for a complicated valve structure is eliminated, so that the apparatus construction can be simplified.

In the foregoing liquid ejecting apparatus, the negative pressure generating mechanism may include a movable wall that forms a portion of a wall surface of the pressure chamber and that is displaceable in such a direction as to change an internal volume of the pressure chamber and an urging member that urges the movable wall in such a direction as to increase the internal volume of the pressure chamber.

According to this construction, a simple structure in which the urging member urges the movable wall makes it possible to generate negative pressure in the pressure chamber.

The foregoing liquid ejecting apparatus may further include a carriage movable back and forth on which the liquid ejecting head and the subsidiary tank are mounted and the liquid introducing portion and the connecting flow path may be connected, due to a movement of the carriage.

According to this construction, the liquid introducing portion and the connecting flow path can be connected by using the carriage that moves the liquid ejecting head. Therefore, a separate drive unit for connecting the liquid introducing portion and the connecting flow path is not needed, so that the apparatus construction can be simplified.

Furthermore, in the foregoing liquid ejecting apparatus, a plurality of subsidiary tanks connected to the liquid ejecting head may be mounted on the carriage and aligned in a direction that intersects directions of back and forth movements of the carriage in a plan view, and a plurality of connecting flow paths of the main tank that correspond to the plurality of subsidiary tanks may have terminal portions arranged to face the corresponding subsidiary tanks.

According to this construction, the direction of the arrangement of the subsidiary tanks and the direction of the arrangement of the terminal portions coincide with each other. Therefore, the liquid introducing portions of the subsidiary tanks can be connected to the terminal portions by merely moving the carriage. Hence, a mere movement of the carriage can complete the connection of the plurality of liquid introducing portions to the corresponding connecting flow paths and, at the same time, can carry out the supply of the liquids to the plurality of subsidiary tanks.

Furthermore, in the foregoing liquid ejecting apparatus, the liquid introducing portion may be provided with a first lid member that covers the receiving member and the first lid member may open and close in coordination with the movements of the carriage.

This construction can inhibit the drying of the receiving member impregnated with the liquid. Particularly in the case where the liquid is an ink or the like that solidifies when dried, the clogging of holes in the receiving member can be inhibited.

Furthermore, in the foregoing liquid ejecting apparatus, the connecting flow path may be provided with a second lid member that covers the terminal portion and the second lid member may open and close in coordination with the movements of the carriage.

This construction can inhibit the drying of the liquid in the terminal portion. Particularly, if the liquid is an ink or the like that solidifies when dried, this construction can inhibit the clogging of the connecting flow path at the terminal portion.

Further, in the foregoing liquid ejecting apparatus, the terminal portion of the connecting flow path may be provided with a supplying member made up of a porous member that seals the terminal portion by being impregnated with the liquid, and the supplying member may receive negative pressure from a reservoir portion side.

According to this construction, meniscuses are formed in holes of the supplying member as is the case with the receiving member, so that the liquid is retained within the holes. Therefore, leakage of the liquid from the terminal portion of the connecting flow path can be inhibited, without a need to provide the terminal portion with a valve structure or the like, so that the apparatus construction can be simplified. In addition, since the holes of the supplying member are impregnated with the liquid, inflow of air bubbles from the terminal portion into the main tank can be inhibited.

Further, in the foregoing liquid ejecting apparatus, an absolute value of the negative pressure that acts on the supplying member from the reservoir portion side may be smaller than an absolute value of the negative pressure that acts in the pressure chamber.

The absolute value of the negative pressure herein means the absolute value of pressure difference from the atmospheric pressure. Therefore, the pressure that acts in the supplying member and tends to draw the liquid to the reservoir portion side is surpassed by the pressure that acts in the receiving member and tends to draw the liquid to the pressure chamber side. According to this construction, connecting the terminal portion to the liquid introducing portion can automatically cause the liquid to flow from the main tank into the subsidiary tank, so that the apparatus can be simplified.

Furthermore, in the foregoing liquid ejecting apparatus, the terminal portion of the connecting flow path may be connected to the liquid introducing portion when the supplying member contacts the receiving member.

This construction makes it possible to join the liquid retained in holes of the receiving member and the liquid retained in holes of the supplying member by bringing the receiving member and the supplying member into contact, so that entry of air bubbles into the liquid at the time of connection between the receiving member and the supplying member can be inhibited.

Further, the foregoing liquid ejecting apparatus may further include a casing that houses the liquid ejecting head and the subsidiary tank, and the reservoir portion of the main tank may be disposed outside the casing.

According to this construction, even when a construction in which an external main tank is provided outside the casing is adopted, the apparatus can be simplified.

Further, in the foregoing liquid ejecting apparatus, the reservoir portion of the main tank may have a refill hole for recharging the liquid from outside.

According to this construction, since the main tank is capable of being supplied with the liquid, it is possible to avoid an incident in which the liquid in the main tank becomes insufficient in amount so that liquid ejection cannot be carried out. Furthermore, the need for replacement of the main tank or the like is eliminated.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
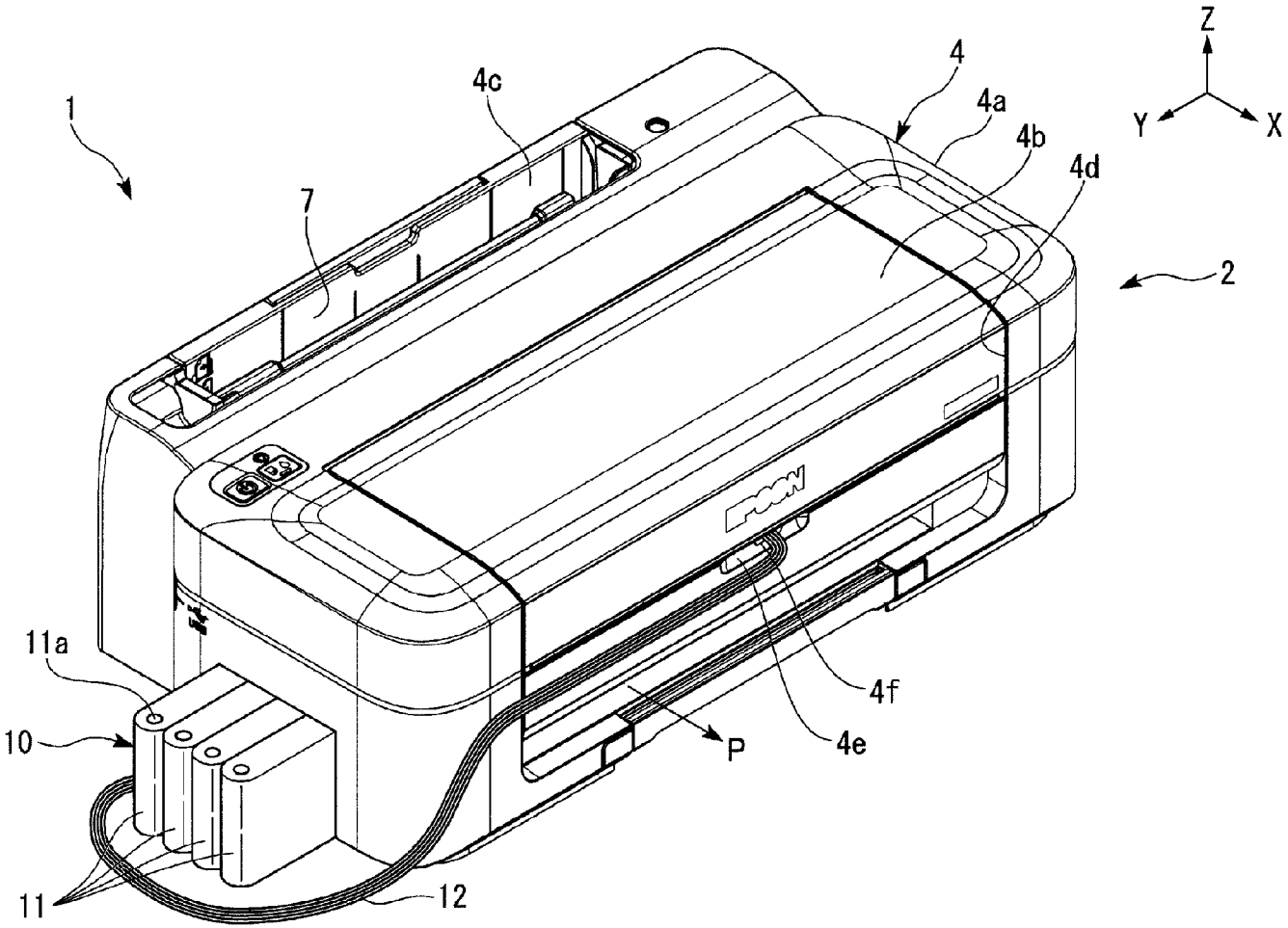
FIG. 1 is a perspective view showing an overall structure of a liquid ejecting apparatus according to an exemplary embodiment of the invention.

An exemplary embodiment of the liquid ejecting apparatus of the invention will be described hereinafter with reference to the drawings. Note that, in the drawings used for the following description, scales are different for various members in the drawings so that the individual members illustrated have such sizes as to be easily recognizable. Furthermore, the drawings are provided, when necessary, with X, Y and Z axes that are orthogonal to each other. The X, Y and Z axes shown in the drawings are defined as follows. In this exemplary embodiment, the Z axis lies in a vertical direction of the liquid ejecting apparatus, the X axis lies in a longitudinal direction of the liquid ejecting apparatus, with the positive X direction being a forward direction and the negative X direction being a rearward direction of the liquid ejecting apparatus, and the Y axis lies in a transverse direction of the liquid ejecting apparatus.

Figure 2:
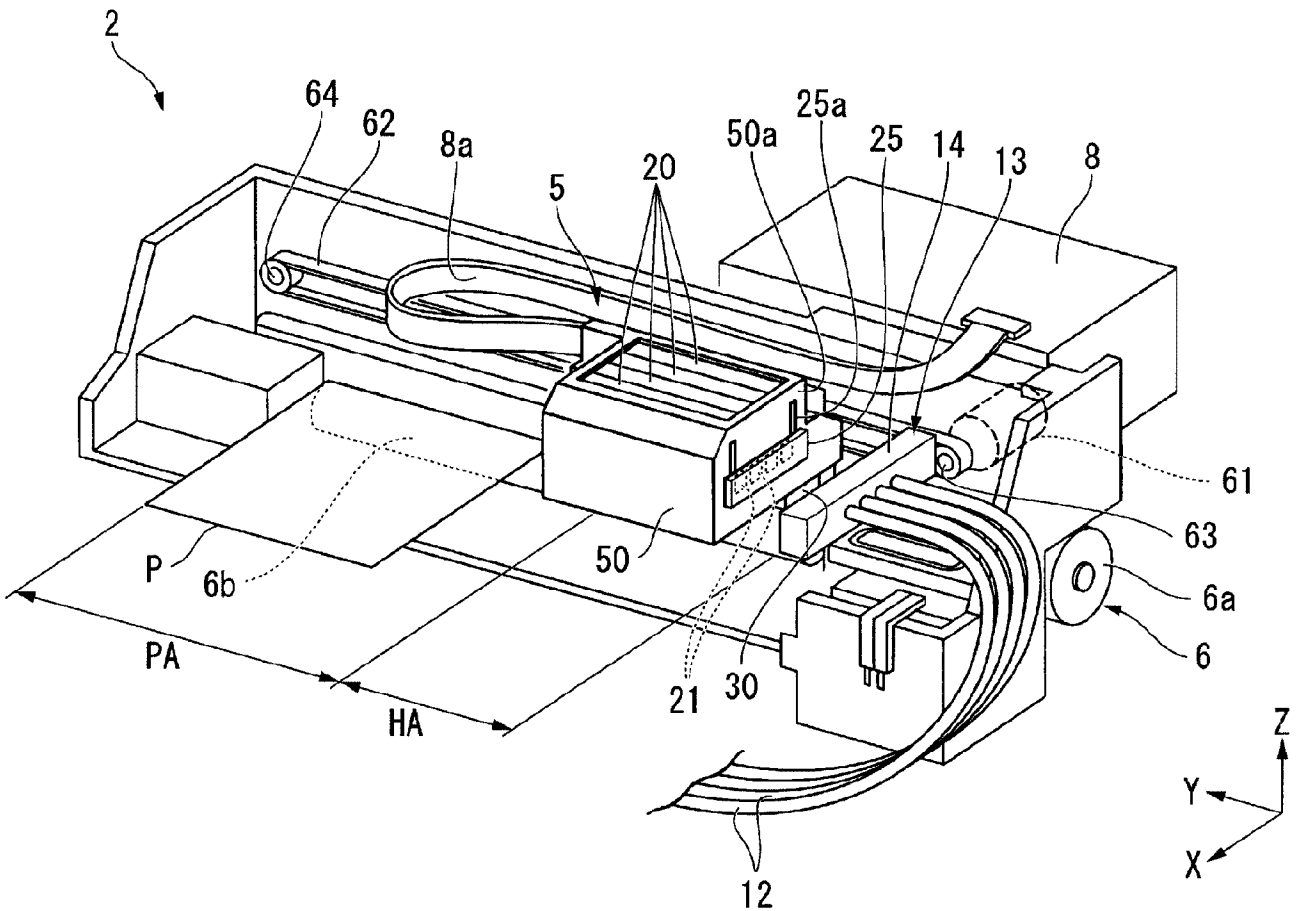
FIG. 2 is a perspective view showing an internal structure of the liquid ejecting apparatus according to the exemplary embodiment.

FIG. 1 is a perspective view showing an overall structure of a liquid ejecting apparatus 1. FIG. 2 is a perspective view showing an interior of a casing 4 of the liquid ejecting apparatus 1.

The liquid ejecting apparatus 1 is, for example, an ink jet printer that performs recording (printing) by ejecting an ink that is an example of a liquid to a medium such as a sheet of paper.

The liquid ejecting apparatus (ink jet printer) 1 includes a printer main body (liquid ejecting apparatus main body) 2 and an external tank (main tank) 10 disposed outside the printer main body 2. Furthermore, as shown in FIG. 2, the printer main body 2 includes a casing 4 and a recording unit 5, a feeder unit (subsidiary scanning mechanism) 6, and a control unit 8 that are disposed inside the casing 4. The recording unit 5 prints (records) data, such as characters, graphics, images, etc., by ejecting the liquid (ink) to a print medium P (a sheet of paper in this exemplary embodiment). The feeder unit 6 guides the print medium P into the casing 4. The feeder unit 6 discharges the print medium P subjected to recording by the recording unit 5 inside the casing 4, to the outside of the casing 4. The control unit 8 is electrically connected to the recording unit 5 and the feeder unit 6 and controls these units.

The casing 4 includes a housing 4*a* that forms an exterior of the casing 4 and a cover 4*b* pivotably mounted on an upper surface of the housing 4*a*. A rear portion of the upper surface of the housing 4*a* is provided with a sheet supply opening 4*c*. The sheet supply opening 4*c* is provided with a hopper 7 in which print media (recording sheets) P are stacked. The hopper 7 is pivotable about an upper portion thereof. The print medium P laid at the uppermost position in the hopper 7 is fed by the feeder unit 6 to the recording unit 5 that is disposed at a downstream side in a transport direction. The housing 4*a* is provided with a front surface opening portion 4*d* that extends from the upper surface to a front surface of the housing 4*a*. The front surface opening portion 4*d* extends in the transverse directions of the printer main body 2. The cover 4*b* is attached to the front surface opening portion 4*d*. The cover 4*b* extends in the transverse directions (Y directions) of the printer main body 2 and has a substantially L-shaped cross section. The cover 4*b* has a pivot shaft (not graphically shown) that extends along a rear-side end portion of the cover 4*b*. The cover 4*b* pivots to open the front surface opening portion 4*d* of the housing 4*a*.

A front-side connecting portion of the housing 4*a* that connects to a front surface end portion of the cover 4*b* is provided with a handhold portion 4*e* that is recessed rearward. The handhold portion 4*e* is for a user to put the user's fingers into when the user hooks fingers on an upper end of the handhold portion 4*e* to raise and open the cover 4*b* upward. Furthermore, the handhold portion 4*e* is provided with an insertion opening 4*f* for insertion of connecting flow paths 12 (described later). The inside and the outside of the casing 4 communicate with each other via the insertion opening 4*f*.

The external tank 10 includes four (plurality of) reservoir portions 11 in which liquids are stored and connecting flow paths 12 connected to the individual reservoir portions 11.

The reservoir portions 11 are disposed along an outside side wall of the casing 4. Each of the reservoir portions 11 is a container in which a liquid (ink) is held. In this exemplary embodiment, the reservoir portions 11 are four reservoir portions that correspond to four color inks (black, yellow, magenta, and cyan). The liquids within the reservoir portions 11 are supplied to an interior of the casing 4 via the connecting flow paths 12. An upper portion of each reservoir portion 11 has a refill hole 11*a* for resupplying the liquid (ink) into the reservoir portion 11 from outside. The refill hole 11*a* is covered with a lid to prevent the liquid in the reservoir portion 11 from drying. It is preferable that each reservoir portion 11 be provided with a window portion for a user to check the amount of the liquid inside the reservoir portion 11. When the liquid level in any one of the reservoir portions 11 is insufficient, the user resupplies that reservoir portion 11 with the liquid via the refill hole 11*a*.

The connecting flow paths 12 of the external tank 10 are tubes that supply the liquids contained in the reservoir portions 11 to an interior of the casing 4. The four connecting flow paths 12 correspond to the four color inks. The connecting flow paths 12 connect the outside and the inside of the casing 4 via the insertion opening 4*f* of the casing 4. Therefore, terminal portions 13 of the connecting flow paths 12 which are at the opposite end of the connecting flow paths to the reservoir portions 11 are located inside the casing 4. The connecting flow paths 12 are fixed to the casing 4 at the insertion opening 4*f* by sticky tape or the like.

The terminal portions 13 of the four connecting flow paths 12 are provided with one common connecting member 14. The connecting member 14 extends in front/rear directions (X-axis directions) that intersect directions of the back and forth movements of a carriage 50 described later (i.e., intersect the Y-axis directions). The connecting member 14 is fixed to the casing 4 via a relay portion that is not graphically shown in the drawings. The four terminal portions 13 are aligned side by side in the front/rear directions (X-axis directions), with their terminal ends directed to a transverse direction-side surface 50*a* of the carriage 50, and are supported on the connecting member 14. Inside the connecting member 14 there are formed four liquid storing chambers 14*a* (see FIG. 3) that correspond to the four connecting flow paths 12. The terminal portions 13 can be connected to and disconnected from liquid introducing portions 21 of subsidiary tanks 20 that will be described later.

The feeder unit 6 constitutes a subsidiary scanning mechanism that moves the print medium P from the rear side to the front side of the printer main body 2. The feeder unit 6 includes a transport motor (transport driving unit) 6*a*, transport rollers (not graphically shown), and a platen (medium support unit) 6*b*. The feeder unit 6 transports the print medium P to the platen 6*b* by transmitting motive power from the transport motor 6*a* to the transport rollers (not graphically shown).

The recording unit 5 includes the carriage 50, four (plurality of) subsidiary tanks 20 mounted on the carriage 50, a liquid ejecting head 30 that is fixed to a lower side of the carriage 50 and that ejects the liquids, and a main scanning drive mechanism 60 that drives the carriage 50.

The main scanning drive mechanism 60 includes a carriage motor 61, a driving roller 63 attached to a rotation shaft of the carriage motor 61, a driven roller 64, and a drive belt 62 wrapped around the driving roller 63 and the driven roller 64. The drive belt 62 extends in the transverse directions (Y-axis directions) of the printer main body 2. Furthermore, the carriage 50 is fixed to the drive belt 62. The drive belt 62 transmits motive power from the carriage motor 61 to the carriage 50.

The liquid ejecting head 30 and the plurality of subsidiary tanks 20 are mounted on the carriage 50. The transverse direction-side surface 50*a* of the carriage 50 is provided with openings (not graphically shown) that are covered with a first lid member 25. The liquid introducing portions 21 of the subsidiary tanks 20 are positioned in the opening. A flat cable 8*a* extending from the carriage 50 is connected to the control unit 8 so that the control unit 8 exchanges electrical signals with the liquid ejecting head 30 and the subsidiary tanks 20 that are mounted on the carriage 50.

The carriage 50 is capable of being moved back and forth in main scanning directions (Y-axis directions) orthogonal to the subsidiary scanning directions by the main scanning drive mechanism 60. The carriage 50 moves over a home area HA at an end side in the transverse directions of the printer main body 2 and a print area PA which is on the opposite side of the home area HA to that end side in the transverse directions of the printer main body 2 and which the print medium P passes through.

When the carriage 50 is in the print area PA, the recording unit 5 ejects liquids from the liquid ejecting head 30 to perform printing on the print medium P.

When the carriage 50 is in the home area HA, maintenance of the liquid ejecting head 30 is performed. More concretely, a cleaning operation of sucking the liquids from nozzles 35 of the liquid ejecting head 30 to inhibit the clogging of the nozzles 35. Furthermore, when the carriage 50 is in the home area HA, the subsidiary tanks 20 are automatically replenished with the liquids (inks) from the external tank 10.

Subsidiary Tanks

The subsidiary tanks 20 temporarily hold therein the liquids (inks) in order to supply the liquids to the liquid ejecting head 30. The four subsidiary tanks 20 are provided corresponding to the inks of four colors (black, yellow, magenta, and cyan). The subsidiary tanks 20 are aligned side by side in directions (X-axis directions) that intersect the back and forth moving directions of the carriage 50 in a plan view and are mounted on the carriage 50. The subsidiary tanks 20 are provided with the liquid introducing portions 21 that receive the liquids from the external tank 10.

The liquid introducing portions 21 are provided as portions of the subsidiary tanks 20 and are aligned in directions (X-axis directions) that intersect the back and forth moving directions of the carriage 50 in a plan view. Each liquid introducing portion 21 corresponds to a terminal portion 13 that faces that liquid introducing portion 21, among the plurality of terminal portions 13 of the connecting flow paths 12 extending respectively from the reservoir portions 11. The liquid introducing portions 21 can be connected to and disconnected from the terminal portion 13 as the carriage 50 moves. When the carriage 50 moves into the home area HA, the liquid introducing portions 21 are connected to the terminal portions 13 of the connecting flow paths 12. That is, the liquid introducing portions 21 and the connecting flow paths 12 are connected, due to a movement of the carriage 50. When the liquid introducing portions 21 and the connecting flow paths 12 are connected, the liquids (inks) move from the external tank 10 to the subsidiary tanks 20.

Concrete constructions of the subsidiary tanks 20, the liquid ejecting head 30, and the terminal portions 13 of the connecting flow paths 12 will be described.

Figure 3:
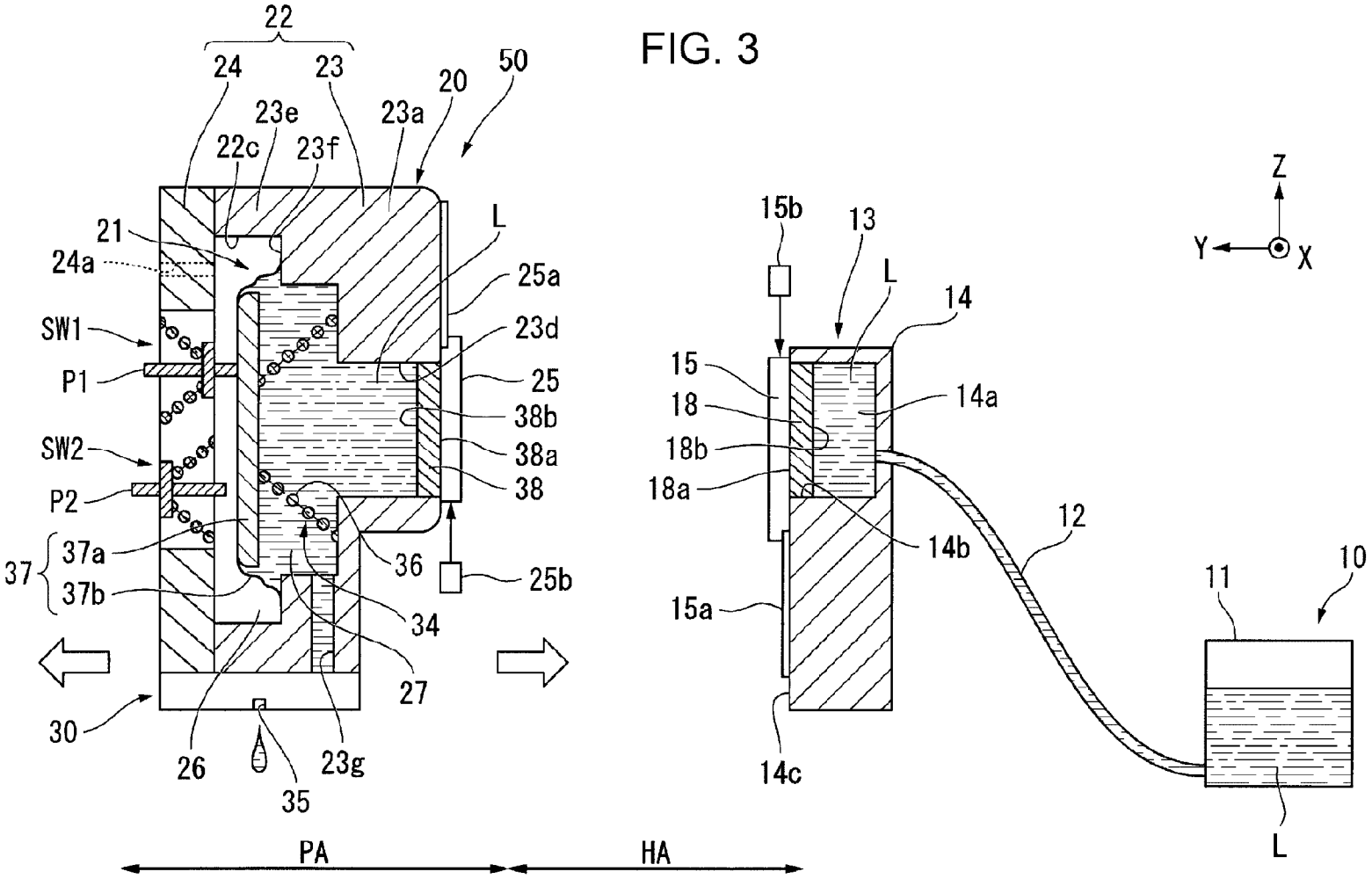
FIG. 3 is a sectional schematic diagram of a subsidiary tank and a terminal portion of a connecting flow path in the exemplary embodiment.

FIG. 3 is a sectional schematic diagram of the subsidiary tanks 20 and the terminal portions 13 of the connecting flow paths 12. Note that in the drawings referred to below, the component members of the main scanning drive mechanism 60 and the carriage 50 are omitted from illustration for the sake of simplified illustration of the constructions.

Each subsidiary tank 20 includes a case member 22 and a liquid introducing portion 21.

The liquid introducing portion 21 includes a negative pressure generating mechanism 34 that includes a movable wall 37 and a coil spring (urging member) 36. The liquid introducing portion 21 also includes a receiving member 38 that is fixed to an opening portion 23*d* of the case member 22 and that receives the liquid from the external tank 10 side.

The subsidiary tanks 20 are connected to the liquid ejecting head 30. The subsidiary tanks 20 may be either detachably attached or undetachably attached to the liquid ejecting head 30. The liquid ejecting head 30 is disposed below the subsidiary tanks 20. The liquid ejecting head 30 has a plurality of nozzles 35 for ejecting the liquids in the form of droplets. The nozzles 35 communicate with the subsidiary tanks 20 that store the four color inks. The nozzles 35 are aligned in the back and forth moving directions of the carriage 50 separately for each color ink.

Although in this exemplary embodiment, it is expediently assumed that the nozzles 35 eject the liquids L in a downward direction (gravity direction), the liquid ejecting direction of the nozzles 35 may also be other than the downward direction.

Each case member 22 includes a case body portion 23 and a case lid portion 24.

The case body portion 23 includes a facing wall 23*a* that faces the terminal portion 13 of a corresponding one of the connecting flow paths 12 and a wall portion 23*e* protruded to a side from a peripheral edge of the facing wall 23*a*. The facing wall 23*a* is provided with the opening portion 23*d* that penetrates a wall surface thereof. The opening portion 23*d* faces the terminal portion 13 of each of the connecting flow paths 12. The receiving member 38 is fixed to the facing wall 23*a* so as to cover the opening portion 23*d*. The wall portion 23*e* is provided with a stepped surface 23*f* that is parallel to the facing wall 23*a*. A storage space 22*c* is formed in a region surrounded by the facing wall 23*a* and the wall portion 23*e*.

The case lid portion 24 is fixed to the wall portion 23*e* of the case body portion 23 so as to be substantially parallel to the facing wall 23*a*. The case lid portion 24 is provided with a first contact switch (first detection switch) SW1 and a second contact switch (second detection switch) SW2. The first contact switch SW1 and the second contact switch SW2 include a contact pin P1 and a contact pin P2, respectively, that are movable in moving directions of the movable wall 37. The first contact switch SW1 and the second contact switch SW2 detect contact of the movable wall 37 with the contact pins P1 and P2, respectively. The contact pin P1 of the first contact switch SW1 is movable over a greater length than the contact pin P2 of the second contact switch SW2. The first contact switch SW1 and the second contact switch SW2 are each capable of indirectly detecting that the liquid level of the liquid L inside a pressure chamber 27 has exceeded a threshold value by detecting through the use of the contact pin P1, P2 that the movable wall 37 has reached a predetermined location. The first contact switch SW1 detects a state in which the liquid L in the pressure chamber 27 is insufficient in amount. The second contact switch SW2 detects a state in which the pressure chamber 27 is filled up with the liquid L.

Note that although in this exemplary embodiment, the contact switches (the first contact switch SW1 and the second contact switch SW2) are adopted as detection switches, other constructions may also be adopted. For example, instead of the contact switches, an optical sensor may be used to detect the displacement of the movable wall 37. In this case, detection of the insufficiency of the liquid L within the pressure chamber 27 and detection of the pressure chamber 27 being filled up with the liquid L may also be executed by one optical sensor.

The storage space 22*c* of each case member 22 includes a pressure chamber 27 and a reserve chamber 26 that are divided by the movable wall 37. Specifically, each subsidiary tank 20 has a pressure chamber 27 and a reserve chamber 26. The internal volume ratio between the pressure chamber 27 and the reserve chamber 26 changes as the movable wall 37 moves.

In the storage space 22*c* of each subsidiary tank 20, the pressure chamber 27 is located at a facing wall 23*a* side. Wall surfaces that form the pressure chamber 27 are surfaces of the movable wall 37 and the facing wall 23*a* and a portion of the wall portion 23*e* of the case body portion 23. The pressure chamber 27 can communicate with the outside via the receiving member 38. As stated below, because the receiving member 38 is impregnated with the liquid L to seal the opening portion 23*d*, the interior of the pressure chamber 27 is tightly closed and the pressure inside the pressure chamber 27 can be changed by movement of the movable wall 37.

The wall portion 23*e* of the case body portion 23 that forms the pressure chamber 27 is provided with a supply hole 23*g* that connects to nozzles 35 of the liquid ejecting head 30. The liquid L stored in the pressure chamber 27 is supplied to the liquid ejecting head 30 through the supply hole 23*g*.

The reserve chamber 26 is located at a case lid portion 24 side within the storage space 22*c*. Wall surfaces that form the reserve chamber 26 are surfaces of the case lid portion 24 and the wall portion 23*e* of the case body portion 23. A wall surface that forms the reserve chamber 26 (a surface of the case lid portion 24 in the example graphically illustrated in drawings) is provided with a through hole 24*a* that provides communication between the inside and the outside of the reserve chamber 26. Therefore, the pressure inside the reserve chamber 26 is the same as the atmospheric pressure.

The negative pressure generating mechanism 34 of each subsidiary tank 20 is located inside the case member 22 and generates negative pressure in the pressure chamber 27. The negative pressure generating mechanism 34 includes the movable wall 37 and the coil spring 36. The movable wall 37 forms part of the wall surfaces of the pressure chamber 27 and is displaceable in such directions as to change the internal volume of the pressure chamber 27. The coil spring 36 presses (urges) the movable wall 37 in such a direction as to move the movable wall 37 away from the facing wall 23*a* so that the internal volume of the pressure chamber 27 can be increased.

The movable wall 37 includes a pressure receiving plate (platy body) 37*a* and a film member 37*b*. The movable wall 37 is displaceable in such directions as to change the internal volume of the pressure chamber 27.

The film member 37*b* is made of a flexible material. A peripheral edge of the film member 37*b* is adhered and fixed to the stepped surface 23*f* of the wall portion 23*e*. Therefore, the film member 37*b* covers the opening portion 23*d* of the facing wall 23*a* in a plan view. The film member 37*b* is fixed in position in a slack state.

The pressure receiving plate 37*a* is made of a metal material or a resin material and has a sufficient rigidity. The pressure receiving plate 37*a* is fixed to and retained by the coil spring 36 so as to be substantially parallel to the facing wall 23*a*. When the pressure receiving plate 37*a* moves to the facing wall 23*a* side, the slack of the film member 37*b* becomes conspicuous. On the other hand, when the pressure receiving plate 37*a* moves to the case lid portion 24, the slack of the film member 37*b* decreases.

The coil spring 36 has a conical shape whose diameter becomes smaller from one side toward the opposite side. The coil spring 36 has one end thereof in contact with the facing wall 23*a* and the opposite end thereof in contact with the pressure receiving plate 37*a* and is compressed between the facing wall 23*a* and the pressure receiving plate 37*a*. The coil spring 36 urges the movable wall 37 in such a direction as to increase the internal volume of the pressure chamber 27. Therefore, the coil spring 36 generates negative pressure inside the pressure chamber 27.

Note that the member that urges the movable wall 37 may also be other than the coil spring 36 (e.g., may be a leaf spring) as long as the member is an urging member that produces a stress in at least one direction. Furthermore, a diaphragm may also be adopted as a form of the negative pressure generating mechanism in which the urging member and the movable wall are integrated. As still another construction of the negative pressure generating mechanism 34, a pressure reducing pump connected to the pressure chamber 27 may also be adopted.

Although in this exemplary embodiment, the subsidiary tanks 20 are each divided into the pressure chamber 27 and the reserve chamber 26 that are arranged side by side in a horizontal direction, the subsidiary tanks 20 may have other arrangements. For example, each subsidiary tank 20 may be divided into a pressure chamber 27 and a reserve chamber 26 that are arranged vertically side by side. Furthermore, by changing the direction in which the pressure chamber 27 and the reserve chamber 26 are divided, the layout of the negative pressure generating mechanism 34, the opening portion 23*d*, the receiving member 38, etc. can also be changed as appropriate.

Figure 4:
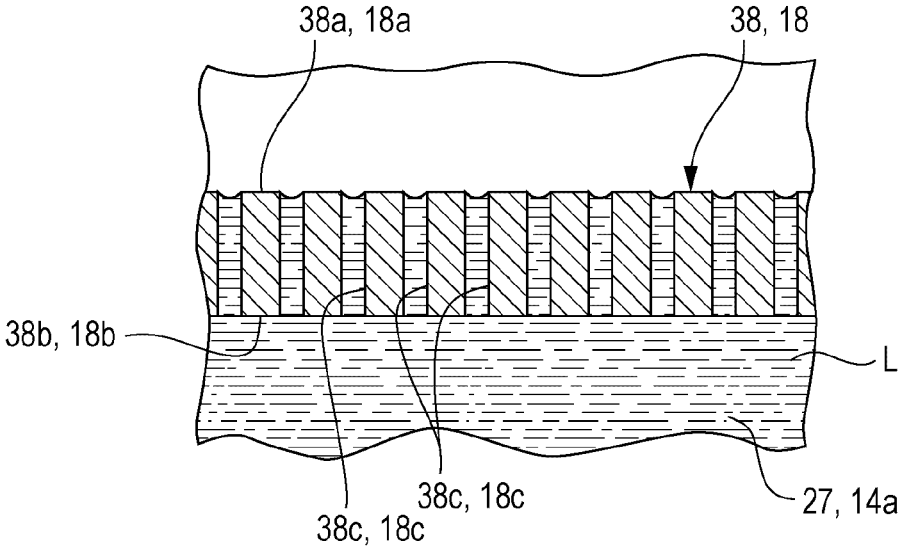
FIG. 4 is a sectional schematic diagram of a receiving member and a supplying member in the exemplary embodiment.

FIG. 4 is a sectional schematic diagram of the receiving member 38 shown in FIG. 3.

Each of the receiving members 38 in the exemplary embodiment is a sheet-shaped porous member having a first surface 38*a* that faces the terminal portion 13 of each of the connecting flow paths 12 and a second surface 38*b* that faces the pressure chamber 27 side. Each receiving member 38 has a plurality of holes 38*c* that provide communication between the first surface 38*a* and the second surface 38*b*.

In this exemplary embodiment, it is assumed that each receiving member 38 is a sheet member having innumerable holes 38*c*. However, the construction of the receiving members 38 is not limited to this construction. For example, the receiving members 38 may be made of a cloth or metal that has numerable holes along a weave pattern or the like or a non-woven fabric that has innumerable irregularly shaped holes. Furthermore, the receiving members 38 may also be resin members in a sponge form.

The pressure chamber 27 of each subsidiary tank 20 draws the liquid (ink) L received at the first surface 38*a* side of the receiving member 38 into the receiving member 38. Thus, the receiving member 38 is impregnated with the liquid L. When the receiving member 38 that is a porous member is impregnated with the liquid L, the holes 38*c* of the receiving member 38 are filled with the liquid L. The liquid L in each hole 38*c*, when negatively pressured at a side, forms meniscuses at the opposite side due to surface tension. The meniscus, a phenomenon in which the surface of a liquid in a hole becomes concave, creates a retaining force that retains the liquid L within the hole 38*c*, balancing a predetermined negative pressure. Since the receiving member 38 is attached to the opening portion 23*d* of the pressure chamber 27 to cover the opening portion 23*d*, the receiving member 38 is impregnated with the liquid L and therefore seals the opening portion 23*d*.

As shown in FIG. 3, the first surfaces 38*a* of the receiving members 38 are covered with the first lid member 25. The first lid member 25 includes a slide mechanism (open-close mechanism) 25*a* that extends in up-down directions and that moves the first lid member 25 up and down and an operation switch 25*b* that moves the first lid member 25 along the slide mechanism 25*a*. The operation switch 25*b* switches the state of the first lid member 25 between open and closed states by driving the first lid member 25 in coordination with movements of the carriage 50.

When the carriage 50 moves so that the subsidiary tanks 20 approach the terminal portions 13 of the connecting flow paths 12, the operation switch 25*b* turns on to move the first lid member 25 along the slide mechanism 25*a* and therefore expose the receiving members 38. When the subsidiary tanks 20 move apart from the terminal portions 13, the operation switch 25*b* turns off, so that the first lid member 25 moves to cover the receiving members 38. That is, the first lid member 25 opens and closes in coordination with movements of the carriage 50.

Terminal Portions of Connecting Flow Paths

As shown in FIG. 3, the terminal portions 13 of the connecting flow paths 12 are provided with the connecting member 14 in which liquid storing chambers 14*a* are formed. An end surface 14*c* of the connecting member 14 which faces the subsidiary tanks 20 is provided with opening portions 14*b* in which the liquid storing chambers 14*a* have openings. Each opening portion 14*b* is provided with a supplying member 18 made up of a porous member. Each supplying member 18 has substantially the same construction as the foregoing receiving members 38 and is impregnated with the liquid L to seal the opening portion 14*b*. Therefore, an interior of each liquid storing chamber 14*a* is tightly closed.

Outside surfaces (first surfaces 18*a*) of the supplying members 18 are covered with a second lid member 15. The second lid member 15 includes a slide mechanism (open-close mechanism) 15*a* that extends in up-down directions and that moves the second lid member 15 up and down and an operation switch 15*b* that moves the second lid member 15 along the slide mechanism 15*a*. The operation switch 15*b* switches the state of the second lid member 15 between open and closed states by driving the second lid member 15 in coordination with movements of the carriage 50.

When the carriage 50 moves so that the subsidiary tanks 20 approach the terminal portions 13 of the connecting flow paths 12, the operation switch 15*b* turns on to move the second lid member 15 along the slide mechanism 15*a* and therefore expose the supplying members 18. When the subsidiary tanks 20 move apart from the terminal portions 13, the operation switch 15*b* turns off, so that the second lid member 15 moves to cover the supplying members 18. That is, the second lid member 15 opens and closes in coordination with movements of the carriage 50.

Incidentally, the operation switches 25*b* and 15*b* provided for the first lid member 25 and the second lid member 15, respectively, may be electrical component parts that are each made up of a sensor and an actuator and may also be switches that mechanically switch the first and second lid members 25 and 15 between the open and closed states. For example, each operation switch 25*b* or 15*b* may be made up of a cam follower attached to the first or second lid member 25 or 15 and a cam provided on the movement path of the carriage 50.

The open-close mechanisms of the first lid member 25 and the second lid member 15 in this exemplary embodiment are mere examples and this function may be realized by adopting any other construction as long as that construction causes the first or second lid member 25 or 15 to open and close in coordination with movements of the carriage 50.

As shown in FIG. 3, the terminal portions 13 of the connecting flow paths 12 are positioned above the reservoir portions 11 of the external tank 10. Therefore, in each terminal portion 13, the liquid storing chamber 14*a* receives negative pressure from the reservoir portion 11 side.

Each supplying member 18, similar to the receiving members 38, is impregnated with the liquid L within the liquid storing chamber 14*a*. As shown in FIG. 4, when a supplying member 18 is impregnated with the liquid L and receives negative pressure on a side (second surface 18*b* side), meniscus liquid surfaces are formed on the opposite side (first surface 18*a* side). The meniscuses of the supplying members 18 bring about retaining force against the negative pressure occurring due to the hydraulic head difference from the reservoir portions 11 and therefore retain the liquid L within holes 18*c*. Since the supplying members 18 are attached to opening portions 14*b* of the liquid storing chambers 14*a* to cover the opening portions 14*b*, the supplying members 18 are impregnated with the liquids L and therefore seal the terminal portions 13.

Although in this exemplary embodiment, the supplying members 18 are caused to receive negative pressure by utilizing hydraulic head difference, such negative pressure may be caused by a negative pressure generating mechanism provided for the liquid storing chambers 14*a*.

The absolute value of the negative pressure that acts on the supplying members 18 from the reservoir portions 11 is smaller than the absolute value of the negative pressure that acts in the pressure chambers 27 of the subsidiary tanks 20. The absolute value of the negative pressure herein means the absolute value of a pressure difference from the atmospheric pressure. Therefore, large absolute values of the negative pressure mean large forces that suck the liquid L from the pressure chambers 27 or the liquid storing chambers 14*a*.

Figure 5:
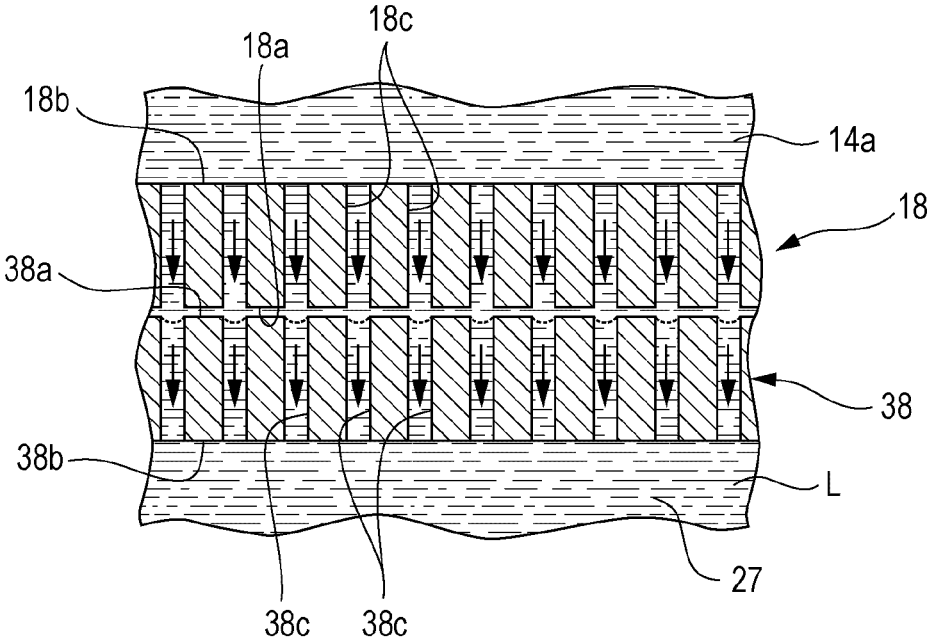
FIG. 5 is a sectional schematic diagram showing a behavior of a liquid when the supplying member and the receiving member are in contact in the exemplary embodiment.

FIG. 5 is a sectional schematic diagram illustrating behaviors of the liquid L when a supplying member 18 and a receiving member 38 are in contact.

As shown in FIG. 5, when the supplying member 18 and the receiving member 38 come into contact, the liquid L retained in the holes 18*c* of the supplying member 18 and the liquid L retained in the holes 38*c* of the receiving member 38 join. Therefore, the concave meniscuses having been formed in the supplying member 18 and the receiving member 38 are filled by the liquid L. The absolute value of the negative pressure that the receiving member 38 receives from the pressure chamber 27 side is larger than the absolute value of the negative pressure that the supplying member 18 receives from the reservoir portion 11 side. Therefore, the liquid L moves from the liquid storing chamber 14*a* to the pressure chamber 27 through the holes 18*c* of the supplying member 18 and the holes 38*c* of the receiving member 38. Hence, the liquid L is supplied from the reservoir portions 11 of the external tank 10 into the pressure chambers 27 of the subsidiary tanks 20.

Operation

Figure 6:
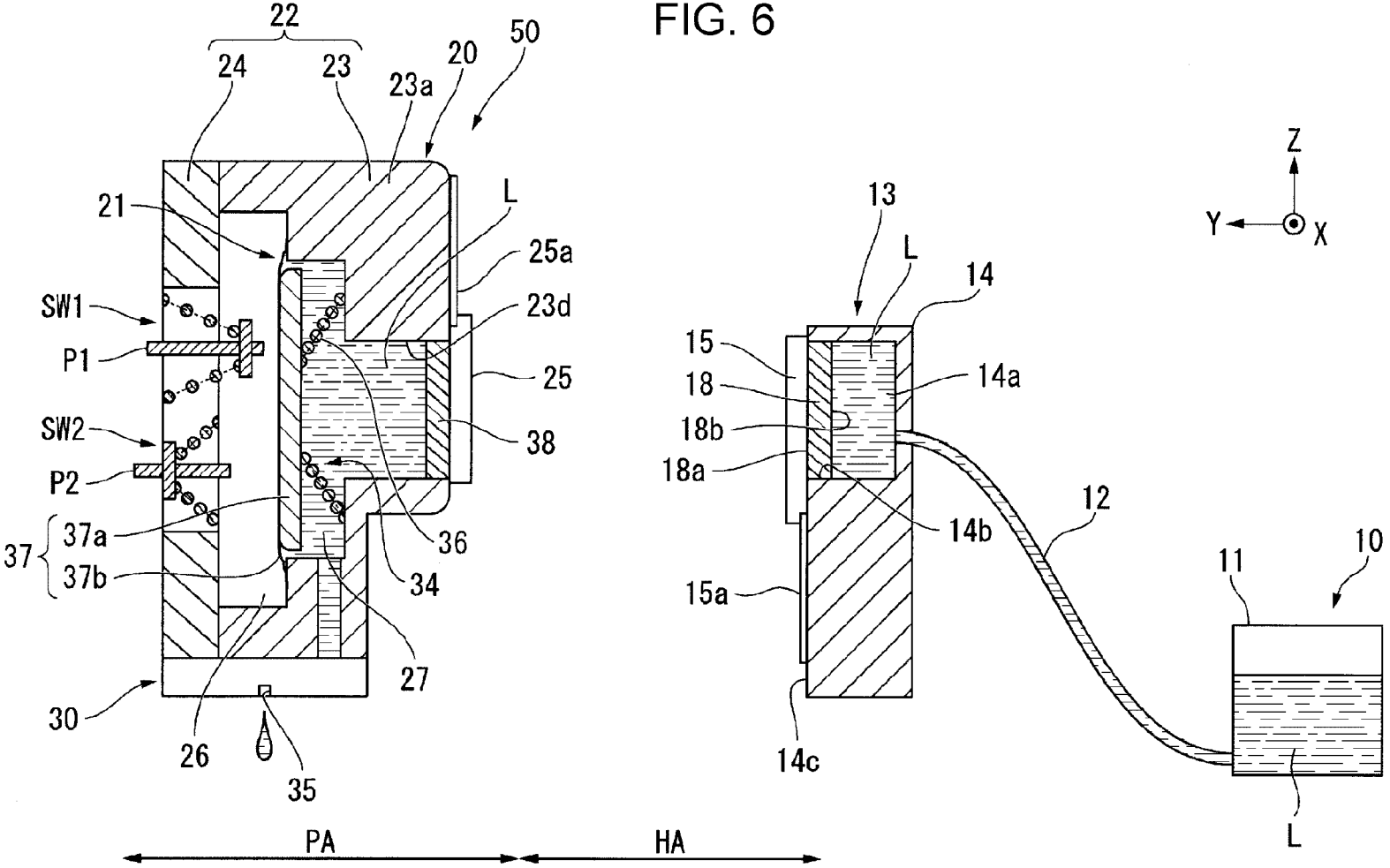
FIG. 6 is a sectional schematic diagram of the subsidiary tank and the terminal portion of the connecting flow path in the exemplary embodiment, showing a state in which the amount of liquid in the subsidiary tank is insufficient.
Figure 7:
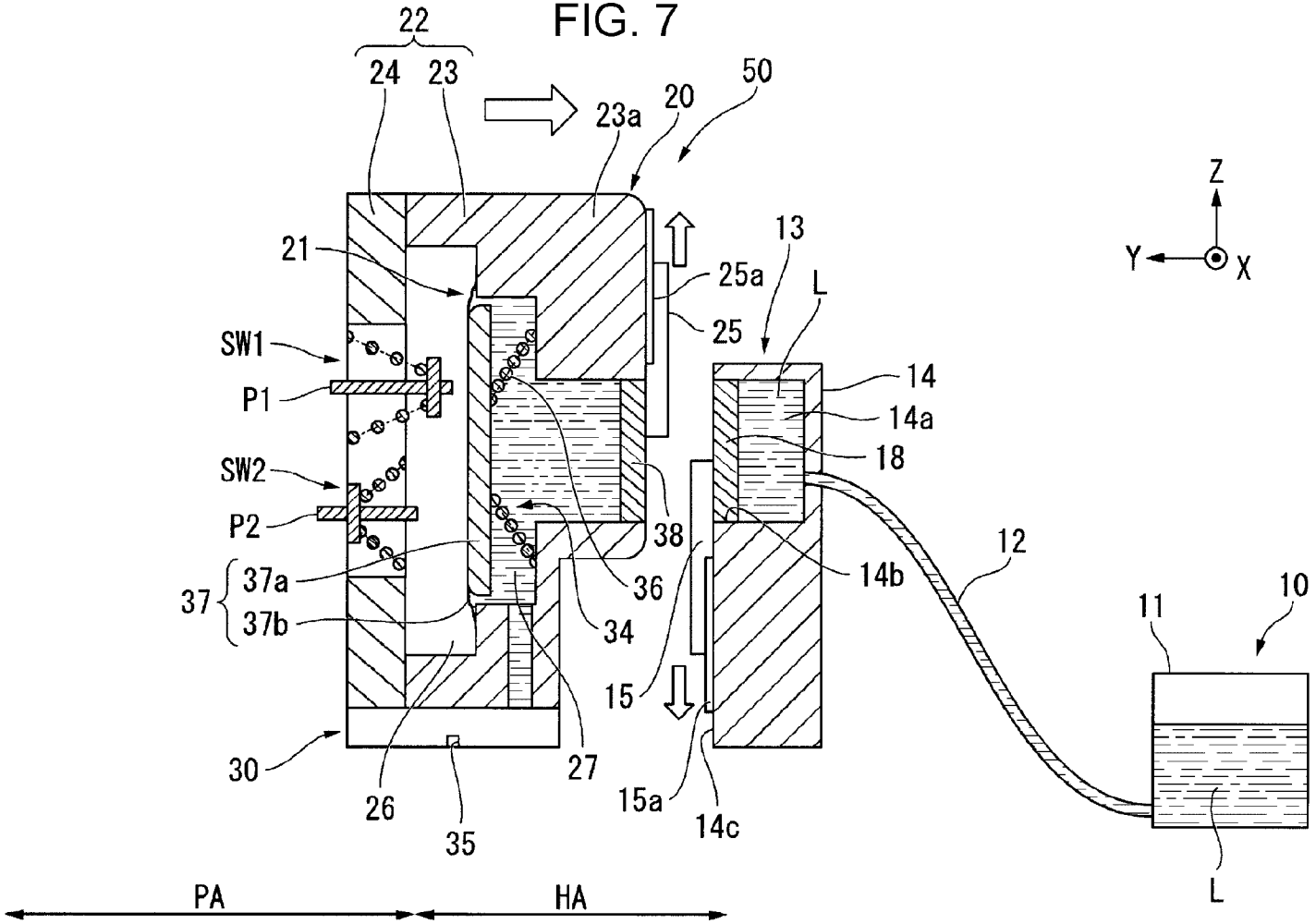
FIG. 7 is a sectional schematic diagram of the subsidiary tank and the terminal portion of the connecting flow path in the exemplary embodiment, showing a state in which the subsidiary tank is approaching the terminal portion and a first lid member and a second lid member are opening.
Figure 8:
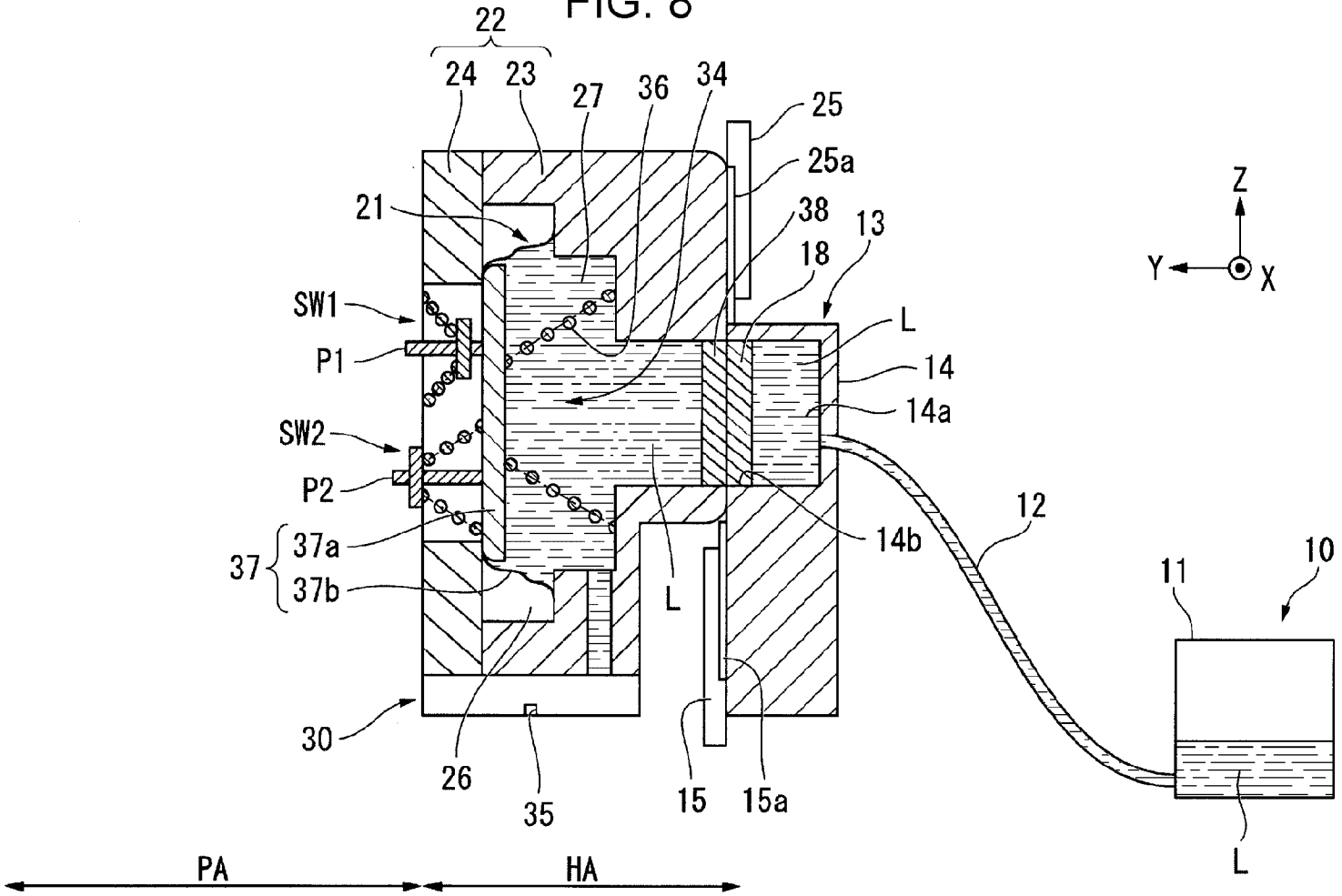
FIG. 8 is a sectional schematic diagram of the subsidiary tank and the terminal portion of the connecting flow path in the exemplary embodiment, showing a state in which a liquid introducing portion and the connecting flow path are connected.

FIGS. 6 to 8, similar to FIG. 3, are sectional schematic diagrams of a subsidiary tank 20 and the terminal portion 13 of the connecting flow path 12, illustrating a procedure of supplying the liquid L from an external tank 10 into the subsidiary tank 20.

As shown in FIG. 6, nozzles 35 of the liquid ejecting head 30 eject the liquid L when the carriage 50 is in the print area PA. As the liquid L is ejected, the liquid L stored in the pressure chamber 27 of the subsidiary tank 20 decreases in amount and therefore the pressure receiving plate 37*a* moves to the facing wall 23*a* side. The first contact switch SW1 detects that the contact pin P1 has separated from the pressure receiving plate 37*a*. A result of detection by the first contact switch SW1 is sent to the control unit 8 (see FIG. 2). Then, the control unit 8 determines that the amount of the liquid L in the subsidiary tank 20 is insufficient and causes the carriage 50 to move to the home area HA.

As shown in FIG. 7, when the carriage 50 moves toward the home area HA, the first lid member 25 moves upward along the slide mechanism 25*a* and the second lid member 15 moves downward along the slide mechanism 15*a*. Therefore, the receiving member 38 of the subsidiary tank 20 and the supplying member 18 of the terminal portion 13 directly face each other.

As shown in FIG. 8, when the carriage 50 reaches the home area HA, the first lid member 25 and the second lid member 15 are completely opened and the receiving member 38 and the supplying member 18 come into contact. Therefore, the terminal portion 13 of the connecting flow path 12 is connected to the liquid introducing portion 21 so that the pressure chamber 27 of the subsidiary tank 20 and the reservoir portion 11 of the external tank 10 communicate with each other via the receiving member 38, the supplying member 18, the terminal portion 13, and the connecting flow path 12. Because the absolute value of the negative pressure that the receiving member 38 receives from the pressure chamber 27 side is larger than the absolute value of the negative pressure that the supplying member 18 receives from the reservoir portion 11 side, the liquid L moves from the liquid storing chamber 14*a* to the pressure chamber 27 side. As the amount of the liquid L in the pressure chamber 27 increases, the pressure receiving plate 37*a* moves to the case lid portion 24 side. Along with this movement, the contact pin P1 of the first contact switch SW1 first contacts the pressure receiving plate 37*a*. A detection result provided by the first contact switch SW1 is sent to the control unit 8 (see FIG. 2). Therefore, the control unit 8 determines that the pressure chamber 27 has started to be filled with the liquid L. When the pressure chamber 27 is filled with a sufficient amount of the liquid L, the contact pin P2 of the second contact switch SW2 contacts the pressure receiving plate 37*a*. A detection result provided by the second contact switch SW2 is sent to the control unit 8 (see FIG. 2). Therefore, the control unit 8 determines that a sufficient amount of the liquid L has filled the pressure chamber 27, causes the carriage 50 to move to the print area PA, and performs a printing process.

In this exemplary embodiment, each subsidiary tank 20 has a construction, as an example, that includes both the first contact switch SW1 that detects that the amount of the liquid L in the pressure chamber 27 has become less than a threshold value and the second contact switch SW2 that detects that the amount of the liquid L in the pressure chamber 27 has exceeded a threshold value. However, a subsidiary tank 20 does not need to include both the first contact switch SW1 and the second contact switch SW2. In the case where a subsidiary tank 20 does not include the first contact switch SW1, the control unit 8 determines whether the amount of the liquid in the pressure chamber 27 is insufficient by estimating the amount of liquid on the basis of an accumulated amount of liquid ejection from the nozzles 35. In the case where a subsidiary tank 20 does not include the second contact switch SW2, the control unit 8 determines whether the supply of the liquid into the pressure chamber 27 has been completed by estimating the amount of the liquid in the pressure chamber 27 on the basis of the duration of the contact between the receiving member 38 and the supplying member 18.

Detection results provided by the first contact switch SW1 and the second contact switch SW2 may also be used to detect an operation error of the subsidiary tank 20. For example, when a detection result provided by the first contact switch SW1 and a detection result provided by the second contact switch SW2 contradict each other, the control unit 8 can determine that a mechanism in the subsidiary tank 20 has some kind of defective condition.

Although in FIGS. 6 to 8, the supply of the liquid to one subsidiary tank 20 is illustrated, substantially the same procedure as described above is used to supply the liquid L when the amount of the liquid L in any one of the four subsidiary tanks 20 is insufficient. In that case, all the subsidiary tanks 20 are simultaneously supplied with the liquids L and, when all the subsidiary tanks 20 are fully filled with the liquids L, the control unit 8 determines that the supply of the liquids L is completed.

According to the liquid ejecting apparatus 1 of this exemplary embodiment, when the terminal portions 13 of the connecting flow paths 12 are connected to the liquid introducing portions 21, the reservoir portions 11 of the external tank 10 communicate with the pressure chambers 27 each of which negative pressure has been applied to, so that the liquids L can flow into the pressure chambers 27. That is, it becomes possible to automatically supply the liquids L from the external tank 10 to the subsidiary tanks 20. Due to this, frequent replacement of cartridges as required in the related-art on-carriage type ink jet printers becomes unnecessary. Furthermore, tubes that connect ink cartridges and a liquid ejecting head as in the related-art off-carriage type ink jet printers also become unnecessary, so that it becomes possible to reduce the size of the apparatus.

Furthermore, in the liquid ejecting apparatus 1 of this exemplary embodiment, the receiving members 38 that receive the liquids L from the external tank 10 are porous members. Therefore, each of the receiving members 38 is impregnated with the liquid L and subjected to negative pressure so that meniscuses are formed and therefore the liquid L is retained. Since the pressure chambers 27 are sealed by the receiving members 38, inflow of air bubbles into the pressure chambers 27 can be inhibited without a need to provide a complicated valve structure. Furthermore, when the meniscus-formed first surface 38*a* side of each receiving member 38 is supplied with the liquid L, the liquid L is drawn in to the second surface 38*b* side that is opposite to the first surface 38*a* side until meniscuses are formed at the first surface 38*a* side. Therefore, there is no need to provide a pressurizing apparatus for supplying the liquid L, so that the apparatus construction can be simplified.

Furthermore, in the liquid ejecting apparatus 1 of this exemplary embodiment, the subsidiary tanks 20 are mounted together with the liquid ejecting head 30 on the carriage 50, and the liquid introducing portions 21 and the connecting flow paths 12 are connected depending on the movement of the carriage 50. Therefore, the liquid ejecting apparatus 1 does not need a separate drive unit for connecting the liquid introducing portions 21 and the connecting flow paths 12, so that the apparatus construction can be simplified.

Furthermore, in the liquid ejecting apparatus 1 of this exemplary embodiment, the subsidiary tanks 20 are aligned in directions that intersect the back and forth moving directions of the carriage 50 in a plan view, and the terminal portions 13 of the connecting flow paths 12 that correspond to the subsidiary tanks 20 are aligned, facing the corresponding subsidiary tanks 20. Therefore, the liquid introducing portions 21 of the subsidiary tanks 20 can be connected to the terminal portions 13 merely by moving the carriage 50. That is, a mere movement of the carriage 50 can complete the connection of the plural liquid introducing portions 21 to the plural connecting flow paths 12 corresponding thereto and, at the same time, can carry out the supply of the liquids to the plural subsidiary tanks 20.

Furthermore, in the liquid ejecting apparatus 1 of this exemplary embodiment, each terminal portion 13 is provided with the supplying member 18 made up of a porous member that is impregnated with the liquid L to seal the terminal portion 13. Because the supplying member 18 receives negative pressure from the reservoir portion 11 side, meniscuses are formed on the outside surface (first surface 18*a*) of the supplying member 18 so that the liquid L is retained within the holes 18*c*. Therefore, without a need to provide the terminal portions 13 with a valve structure, leakage of the liquids L from the terminal portions 13 can be inhibited and inflow of air bubbles into the external tank 10 can also be inhibited.

Furthermore, in the liquid ejecting apparatus 1 of this exemplary embodiment, the absolute value of the negative pressure that acts on the supplying members 18 from the reservoir portion 11 side is smaller than the absolute value of the negative pressure that acts in the pressure chambers 27. Therefore, the pressure in the supplying members 18 which tends to draw the liquids L to the reservoir portion 11 side is surpassed by the pressure in the receiving members 38 that tends to draw the liquids L to the pressure chamber 27 side. Therefore, connecting the terminal portions 13 to the liquid introducing portions 21 can automatically cause the liquids L to flow from the external tank 10 to the subsidiary tanks 20, so that the apparatus can be simplified.

Furthermore, in the liquid ejecting apparatus 1 of this exemplary embodiment, the supplying members 18 and the receiving members 38 contact each other as the terminal portions 13 of the connecting flow paths 12 are connected to the liquid introducing portions 21. Therefore, the liquids L retained in holes of each of the receiving members 38 and holes of a corresponding one of the supplying members 18 can be joined by bringing the receiving member 38 and the supplying member 18 into contact, so that entry of air bubbles into the liquids L at the time of connection between the receiving members 38 and the supplying members 18 can be inhibited.

Furthermore, in the liquid ejecting apparatus 1 of this exemplary embodiment, the receiving members 38 and the supplying members 18 are covered by the first lid member 25 and the second lid member 15, respectively. This construction inhibits the drying of the liquids L held in the receiving members 38 and the supplying members 18 and prevents the clogging of holes of the receiving members 38 and the supplying members 18. Furthermore, the first and second lid members 25 and 15 are each constructed to open and close in coordination with the movements of the carriage 50 and therefore do not impede connection between the receiving members 38 and the supplying members 18.

Still further, in the liquid ejecting apparatus 1 of this exemplary embodiment, the casing 4 houses the feeder unit 6 and the recording unit 5 that includes the liquid ejecting head 30, the subsidiary tanks 20, the carriage 50, etc., and the external tank 10 are disposed outside the casing 4. The reservoir portion 11 of the external tank 10 is provided with the refill hole 11*a* for re-supplying the liquid L from outside. This construction allows the external tank 10 to be supplied with the liquid L and makes it possible to avoid an incident where the amount of the liquid L in an external tank 10 is insufficient and thereby the liquid ejection is impossible. Furthermore, it becomes unnecessary to perform replacement of the external tank 10 and the like.

It is preferable that the reservoir portion 11 of each external tank 10 be provided with a sensor that detects insufficiency of the liquid. This makes it possible to perform control that inhibits the liquids L in the external tank 10 from becoming insufficient in amount and therefore inhibits air bubbles from flowing into the subsidiary tanks 20 from the external tank 10. In order to prevent inflow of air, it is also permissible to provide a valve body (e.g., a float valve) that closes a connecting flow path 12 when the amount of liquid in a corresponding one of the reservoir portions 11 is less than or equal to a predetermined amount.

Modification 1

Figure 9:
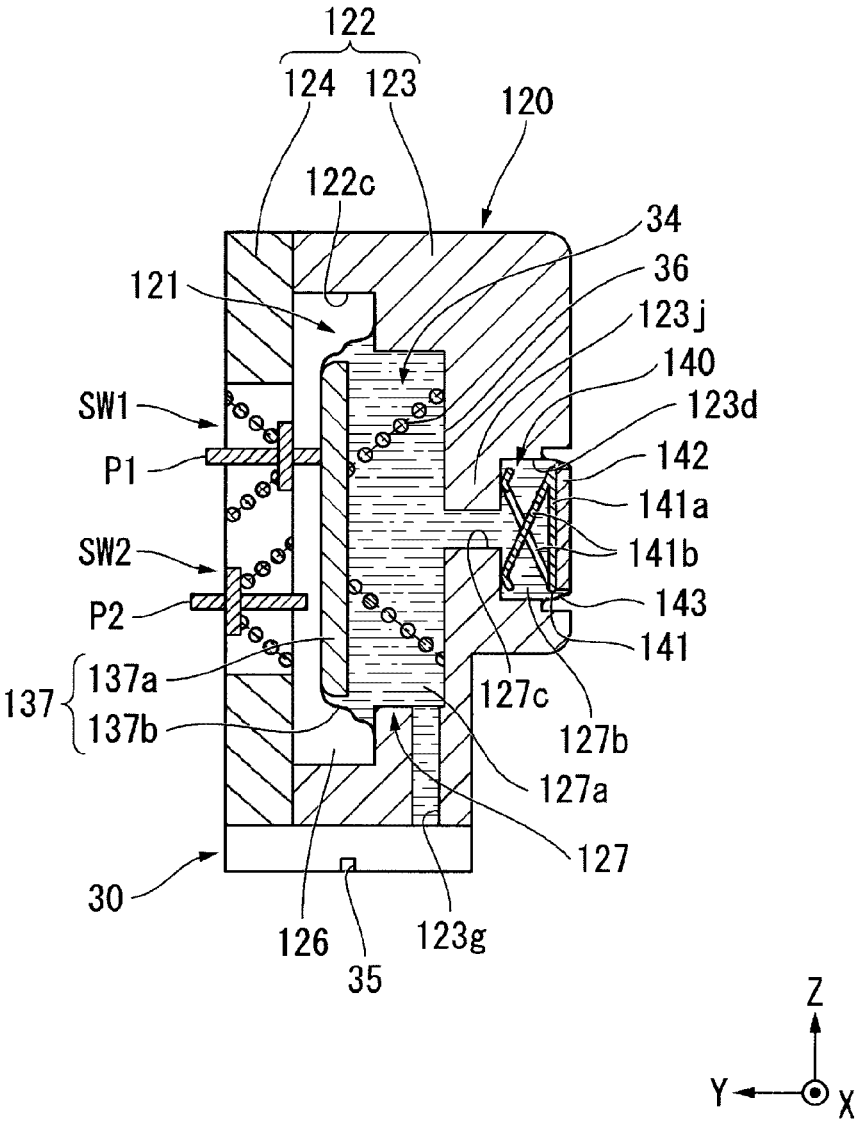
FIG. 9 is a sectional schematic diagram of a subsidiary tank according to Modification 1.

FIG. 9 shows a general schematic diagram of a subsidiary tank 120 according to Modification 1 that is adoptable in the foregoing exemplary embodiment. The subsidiary tank 120 in this modification is different from the foregoing subsidiary tanks 20 mainly in that a pressure chamber 127 is divided into a first liquid chamber 127*a* and a second liquid chamber 127*b* and the second liquid chamber 127*b* is provided with a receiving structure portion 140. Note that substantially the same component elements as those in the foregoing exemplary embodiment are given the same reference characters and the description thereof will be omitted.

The subsidiary tank 120 of this modification includes a case member 122 that includes a case body portion 123 and a case lid portion 124 and that forms therein a storage space 122*c*. The subsidiary tank 120 further includes a liquid introducing portion 121. The liquid introducing portion 121 includes the receiving structure portion 140 and a negative pressure generating mechanism 134 that includes a movable wall 137 and a coil spring (urging member) 136.

Furthermore, a liquid ejecting head 30 is provided on a lower side of the subsidiary tank 120. The liquid ejecting head 30 is connected to the subsidiary tank 120 through a supply hole 123*g*. As in the foregoing exemplary embodiment, the subsidiary tank 120 and the liquid ejecting head 30 are movable back and forth by a carriage that is not graphically shown in FIG. 9.

The storage space 122*c* in the case member 122 includes the pressure chamber 127 and a reserve chamber 126 that are partitioned by the movable wall 137. The internal volume ratio between the pressure chamber 127 and the reserve chamber 126 changes as the movable wall 137 moves.

The movable wall 137 includes a pressure receiving plate (platy body) 137*a* and a film member 137*b*. The movable wall 137 is displaceable in such directions as to change the internal volumes of the pressure chamber 127 and the reserve chamber 126.

The pressure chamber 127 is divided into the first liquid chamber 127*a* and the second liquid chamber 127*b* by a dividing wall 123*j* of the case body portion 123. The first liquid chamber 127*a* and the second liquid chamber 127*b* communicate with each other through a communication path 127*c* that is provided in the dividing wall 123*j*. Therefore, the pressure inside the first liquid chamber 127*a* and the pressure inside the second liquid chamber 127*b* are equal. The first liquid chamber 127*a* is provided with an opening portion 123*d*. The opening portion 123*d*, as in the first exemplary embodiment, has an opening that faces the terminal portion 13 of a connecting flow path 12 (not shown in FIG. 9). The receiving structure portion 140 is provided inside the second liquid chamber 127*b*. The negative pressure generating mechanism 134 is provided inside the first liquid chamber 127*a*.

The receiving structure portion 140 includes a leaf spring (urging member) 141, a foam member 142, and a receiving film (receiving member) 143. The receiving film 143 is provided so as to cover the opening portion 123*d*. The foam member 142 and the leaf spring 141 are positioned inside the first liquid chamber 127*a*.

The receiving film 143 is adhered and fixed at its peripheral edge portion to the case member 122 so as to be in a slack state and cover the opening portion 123*d*. The receiving film 143 is a porous member provided on an outermost surface of the receiving structure portion 140. Examples of the receiving film 143 that are adoptable in this modification include a piece of woven fabric, a piece of non-woven fabric, a filter provided with innumerable holes formed by a press processing or the like, etc. The receiving film 143 is impregnated with a liquid. Because negative pressure is generated in the pressure chamber 127, meniscuses are formed in holes of the receiving film 143. Therefore, the receiving film 143 can seal the pressure chamber 127. Furthermore, the pressure chamber 127 can communicate with the outside via the receiving film 143. The receiving film 143, similar to the receiving member 38 in the foregoing exemplary embodiment (see FIG. 3 and FIG. 5), contacts a supplying member 18, so that the liquid is drawn in from the supplying member 18 side. Therefore, the liquid can be introduced into the subsidiary tank 120 from the external tank 10.

The leaf spring 141 has a support portion 141*a* in contact with the foam member 142 and a pair of leg portions 141*b* extending from the support portion 141*a* to the opposite side to the foam member 142 and being in contact with the dividing wall 123*j*. The support portion 141*a* retains the foam member 142. The two leg portions 141*b* intersect each other. The leaf spring 141 is compressed between the dividing wall 123*j* and the foam member 142.

The leaf spring 141 urges the receiving film 143 outward via the foam member 142.

The foam member 142 is a porous member disposed between the leaf spring 141 and the receiving film 143. Holes formed in the foam member 142 function as flow paths that introduce into the pressure chamber 127 the liquid supplied from outside via the receiving film 143.

The receiving structure portion 140 according to this modification can change the posture (or shape) of the outside surface (reception surface) of the receiving film 143 because the leaf spring 141 is provided. Therefore, when the outside surface (reception surface) of the receiving film 143 is pressed against the supplying member 18 (see FIG. 3), the posture of the reception surface changes along the supplying member 18 so that the receiving film 143 has a sufficiently large area of contact that is in contact with the supplying member 18.

Modification 2

Figure 10:
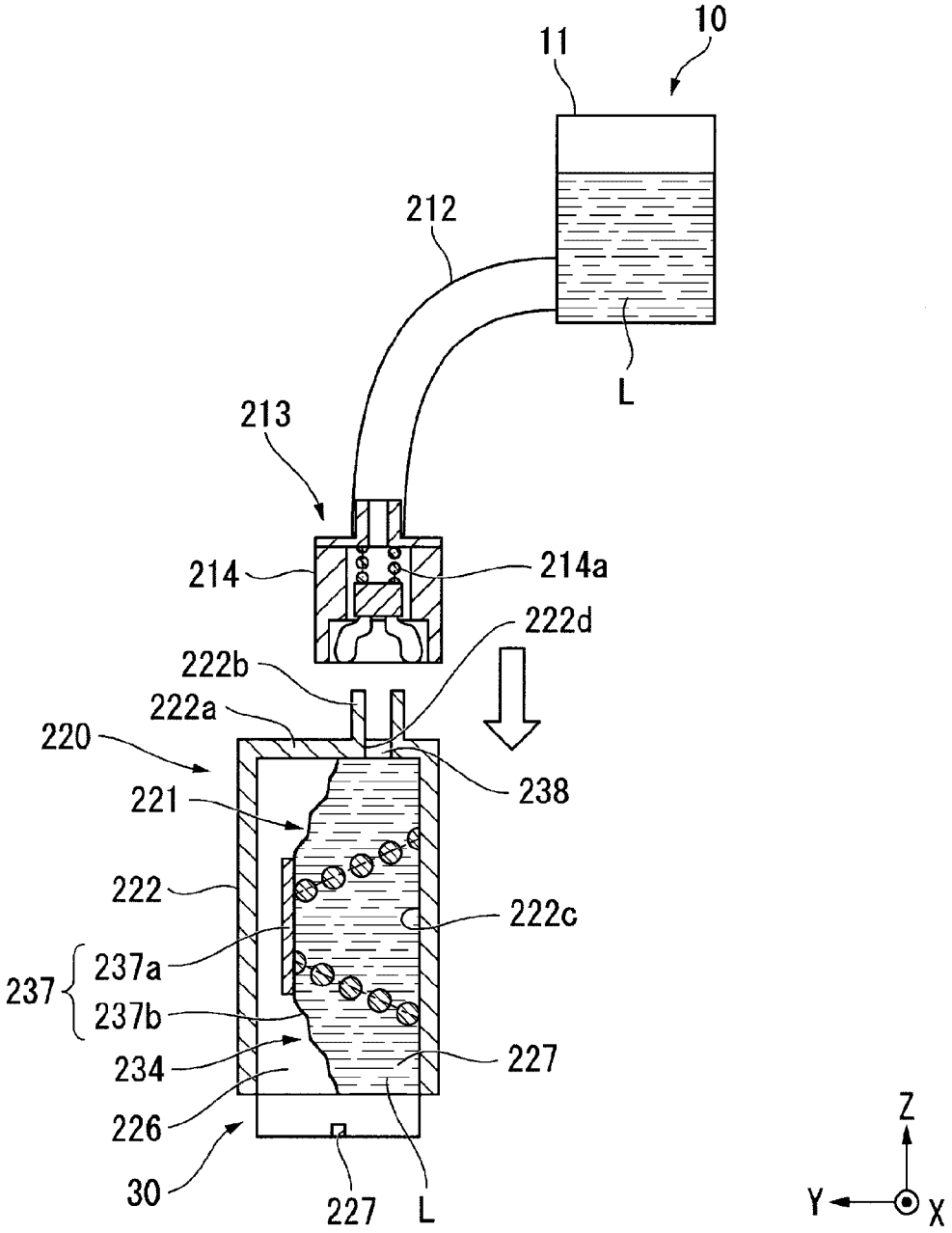
FIG. 10 is a sectional schematic diagram of a subsidiary tank and a terminal portion of a connecting flow path according to Modification 2.

FIG. 10 shows a general schematic diagram of a subsidiary tank 220 and a connecting flow path 212 according to Modification 2 adoptable in the foregoing exemplary embodiment. Note that substantially the same component elements as those in the foregoing exemplary embodiment are given the same reference characters and the description thereof will be omitted.

The subsidiary tank 220 in this modification includes a case member 222 that is provided with an internal storage space 222*c* and that has on its upper side an opening portion 222*d*, and further includes a liquid introducing portion 221. The liquid introducing portion 221 includes a negative pressure generating mechanism 234 that includes a movable wall 237 and a coil spring (urging member) 236 and a receiving member 238 made up of a porous member that is fixed to the opening portion 222*d* of the case member 222 and that receives a liquid from an external tank 10 side.

Furthermore, a liquid ejecting head 30 is provided on a lower side of the subsidiary tank 220. The liquid ejecting head 30 is connected to the subsidiary tank 220. As in the exemplary embodiment, the subsidiary tank 220 and the liquid ejecting head 30 are movable back and forth by a carriage that is not graphically shown.

Of wall portions that form the case member 222, an upper wall 222*a* that covers an upper side of the storage space 222*c* is provided with the opening portion 222*d*. The upper wall 222*a* is provided also with a tubular portion 222*b* protruded upward from an edge portion of the opening portion 222*d*.

In the storage space 222*c* of the case member 222 there are provided a pressure chamber 227 and a reserve chamber 226 partitioned by a movable wall 237. The internal volume ratio between the pressure chamber 227 and the reserve chamber 226 changes as the movable wall 237 moves.

The movable wall 237 includes a pressure receiving plate (platy body) 237*a* and a film member 237*b*. The movable wall 237 is displaceable in such directions as to change the internal volumes of the pressure chamber 227 and the reserve chamber 226.

The pressure chamber 227 can communicate with the outside via a receiving member 238. The receiving member 238 is impregnated with the liquid L and therefore seals the opening portion 222*d*. Hence, the interior of the pressure chamber 227 is tightly closed, so that the pressure inside the pressure chamber 227 changes as the movable wall 237 moves. Furthermore, the pressure chamber 227 connects to nozzles 35 of a liquid ejecting head 30 through a supply hole that is not graphically shown.

A terminal portion 213 of a connecting flow path 212 is located below a reservoir portion 11 of the external tank 10. The terminal portion 213 faces downward.

The terminal portion 213 of the connecting flow path 212 is provided with a connecting member 214. The connecting member 214 has a valve structure that has therein a coil spring 214*a*. The terminal portion 213 is sealed by the valve structure of the connecting member 214. Furthermore, the connecting member 214 is supported by a driving unit (not graphically shown) that drives the connecting member 214 in up-down directions. Therefore, the connecting member 214 can be moved up and down.

In this modification, the subsidiary tank 220 is designed so that the opening portion 222*d* can be positioned under the connecting flow path 212 as the carriage moves. Furthermore, the connecting flow path 212 is connected to the opening portion 222*d*, due to a movement of the connecting member 214 in the up-down direction. When the connecting member 214 is moved downward, the coil spring 214*a* inside the connecting member 214 is pushed by the tubular portion 222*b* to open the valve structure. Since the terminal portion 213 is located below the reservoir portions 11, the liquid L flows, due to hydraulic head difference, to the subsidiary tank 220 side and then into the pressure chamber 227 through the receiving member 238. In this modification, the liquid supply from the external tank 10 to the subsidiary tank 220 can be carried out by the foregoing procedure.

According to this modification, similar to the foregoing exemplary embodiment, since the receiving member 238 is provided between the pressure chamber 227 and the connecting flow path 212, inflow of air bubbles into the pressure chamber 227 can be inhibited. Furthermore, since hydraulic head difference is utilized to supply the liquid L from the external tank 10 to the subsidiary tank 220, the supply of the liquid L can be carried out at high speed.

Furthermore, in this modification, the terminal portion 213 of the connecting flow path 212 is located below the reservoir portion 11 of the external tank 10. Therefore, if an air bubble should flow into the terminal portion 213 from the valve structure of the connecting member 214, the bubble will move to the reservoir portion 11 side and therefore can be easily removed. That is, in the terminal portion 213, an air bubble will not flow into the liquid introducing portion 221 nor impede the supply of the liquid L.

While the exemplary embodiment and the modifications according to the invention have been described above, the constructions in the exemplary embodiment and the modifications, combinations thereof, and the like are mere examples and addition of further constructions, omission or substitution of any of the constructions, and other changes can be made without departing from the gist of the invention. The invention is not restricted by the foregoing exemplary embodiment.

For example, although in the foregoing exemplary embodiment, the external tank 10 that can be replenished are adopted as a main tank, it is also permissible to adopt as a main tank a large-capacity ink pack or a replaceable cartridge.

Furthermore, in the foregoing exemplary embodiment, open/close valves may be provided inside the connecting flow paths 12 and a suction hole for sucking air bubbles present in a pressure chamber 27 may be disposed in an upper portion of each pressure chamber 27. This will improves the discharging of gas from inside the pressure chambers 27. In the case where the pressure chambers 27 are provided with suction holes, it is preferable that the suction holes be provided with open/close valves so that the suction holes are open to suck air bubbles only when the liquid introducing portions 21 are connected to the connecting flow paths 12. A suction mechanism connected to the suction holes may utilize a suction mechanism that performs head maintenance, so that the apparatus construction can be simplified.

In the foregoing exemplary embodiment, the terminal portions 13 of the connecting flow paths 12 are connected to the liquid introducing portions 21 when the subsidiary tanks 20 are moved into the home area HA where the maintenance of the liquid ejecting head is performed. However, the terminal portions 13 may be located at the side opposite to the home area in the back and forth moving directions of the carriage 50.

Furthermore, although in the foregoing exemplary embodiment, the reservoir portions 11 are disposed at the side opposite to the position at which the liquid introducing portions 21 and the terminal portions 13 of the connecting flow paths 12 are connected, the reservoir portions 11 may be disposed at the same side as the position for the connection. Therefore, the length of the connecting flow paths 12 can be minimized, so that the apparatus construction can be further simplified.

Further, in the foregoing exemplary embodiment, a mechanism that returns the liquid (waste ink) sucked from the nozzles during the head maintenance to the main tank and reuses the liquid may be provided.

The liquid ejecting apparatus in the foregoing exemplary embodiment may be a thermal jet printer and may also be a line ink jet printer. The liquid ejecting apparatus is not limited to printers but may also be other apparatuses such as a copying machine and a facsimile.

Although the liquid ejecting apparatus in the foregoing exemplary embodiment is an ink jet printer that ejects four color inks, the number of color inks is not limited to four but can be changed according to the construction of the printer.

Furthermore, the liquid ejecting apparatus may also have a construction in which a liquid other than ink is ejected or discharged. The invention is applicable to various liquid ejecting apparatuses that, for example, are each equipped with a liquid ejecting head that discharges liquid droplets of a very small amount or the like. Note that the term liquid droplets refers to a state of a liquid discharged from the liquid ejecting apparatus and includes particulate shaped droplets, so-called teardrop shaped droplets, and stringy droplets that tend to form thready tails. Furthermore, as for the liquid mentioned herein, a material that can be discharged from the liquid ejecting apparatus suffices. What suffice as the liquid are, for example, substances in a liquid phase, include high-viscosity or low-viscosity liquid materials, sols, gel water, and other fluidal materials such as inorganic solvents, organic solvents, solutions, liquid resins, and liquid metals (metal melts), and further include not only liquids as a state of substances but also materials in which a particle of a functional material made up of a solid, such as a pigment or a metal particle, is dissolved, dispersed, or mixed in a solvent, etc. Representative examples of the liquid are not limited to ink as described above in conjunction with the foregoing exemplary embodiment but may also include, among others, liquid materials obtained by dispersing or mixing a particle of a functional material in liquids. For example, the liquid ejecting apparatus may be constructed so as to perform recording by ejecting a liquid material that contains in the form of a dispersion or solution a material such as a color material (pixel material) or an electrode material used in the production of liquid crystal displays, electroluminescence (EL) displays, surface emitting displays, etc. The ink in the foregoing exemplary embodiment includes aqueous inks and oil-based inks as commonly used and various other liquid compositions such as gel inks and hot melt inks.

The liquid that the liquid ejecting head ejects is not limited to ink. Furthermore, the print medium is not limited to a sheet of paper but may also be a plastic film or a thin plate material and, furthermore, may be a cloth for use in textile printing apparatuses or the like.

The entire disclosure of Japanese Patent Application No. 2016-023393, filed Feb. 10, 2016, is expressly incorporated by reference herein.

What is claimed is:

1. A liquid ejecting apparatus comprising:

a liquid ejecting head that ejects a liquid;

a subsidiary tank connected to the liquid ejecting head; and a main tank capable of supplying the liquid to the subsidiary tank, wherein the subsidiary tank is provided with a liquid introducing portion that receives the liquid from the main tank, wherein the liquid introducing portion includes a receiving member that is exposed to an outside and receives the liquid from the main tank, a pressure chamber capable of communicating with the outside via the receiving member, and a negative pressure generating mechanism that generates negative pressure in the pressure chamber, wherein the receiving member is a porous member that seals the pressure chamber by being impregnated with the liquid, wherein the main tank includes a reservoir portion in which the liquid is stored and a connecting flow path that extends from the reservoir portion, and wherein the connecting flow path is provided with a terminal portion that delivers the liquid to the subsidiary tank, wherein the terminal portion includes a supplying member that is exposed to the outside and that is connectable to and disconnectable from the receiving member, wherein the supplying member is the porous member that seals the terminal portion by being impregnated with the liquid.

2. The liquid ejecting apparatus according to claim 1, wherein the negative pressure generating mechanism includes a movable wall that forms a portion of a wall surface of the pressure chamber and that is displaceable in such a direction as to change an internal volume of the pressure chamber and an urging member that urges the movable wall in such a direction as to increase the internal volume of the pressure chamber.

3. The liquid ejecting apparatus according to claim 1, further comprising a carriage movable back and forth on which the liquid ejecting head and the subsidiary tank are mounted, wherein the liquid introducing portion and the connecting flow path are connected, due to a movement of the carriage.

4. The liquid ejecting apparatus according to claim 3, wherein a plurality of subsidiary tanks are connected to the liquid ejecting head, mounted on the carriage, and aligned in a direction that intersects directions of back and forth movements of the carriage in a plan view, and wherein a plurality of connecting flow paths of the main tank that correspond to the plurality of subsidiary tanks have terminal portions arranged to face the corresponding subsidiary tanks.

5. The liquid ejecting apparatus according to claim 3, wherein the liquid introducing portion is provided with a first lid member that covers the receiving member and the first lid member opens and closes in coordination with the movements of the carriage.

6. The liquid ejecting apparatus according to claim 3, wherein the connecting flow path is provided with a second lid member that covers the terminal portion and the second lid member opens and closes in coordination with the movements of the carriage.

7. The liquid ejecting apparatus according to claim 1, wherein the supplying member receives negative pressure from a reservoir portion side.

8. The liquid ejecting apparatus according to claim 7, wherein an absolute value of the negative pressure that acts on the supplying member from the reservoir portion side is smaller than an absolute value of the negative pressure that acts in the pressure chamber.

9. The liquid ejecting apparatus according to claim 1, further comprising a casing that houses the liquid ejecting head and the subsidiary tank, wherein the reservoir portion of the main tank is disposed outside the casing.

10. The liquid ejecting apparatus according to claim 1, wherein the reservoir portion of the main tank has a refill hole for recharging the liquid from outside.

* * * * *